United States Patent [19]

Peytavin

[11] 4,091,650

[45] May 30, 1978

[54] ROLLING MILL FOR FORMING SEAMLESS TUBES, AND SEAMLESS TUBE-MAKING APPARATUS COMPRISING SUCH A MILL

[75] Inventor: Pierre Peytavin, Neuilly-sur-Seine, France

[73] Assignee: Vallourec (Usines a Tubes de Lorraine-Escaut et Vallourec Reunies), Paris, France

[21] Appl. No.: 759,660

[22] Filed: Jan. 17, 1977

[30] Foreign Application Priority Data

Jan. 19, 1976 France ..... 76 01240

[51] Int. Cl.[2] ..... B21B 17/10

[52] U.S. Cl. ..... 72/209

[58] Field of Search ..... 72/208, 209, 250, 97

[56] References Cited

U.S. PATENT DOCUMENTS

| | | | |
|---|---|---|---|
| 3,392,565 | 7/1968 | Rodder | 72/209 X |

FOREIGN PATENT DOCUMENTS

| | | | |
|---|---|---|---|
| 2,163,818 | 6/1973 | Germany | 72/209 |
| 2,331,812 | 1/1975 | Germany | 72/209 |
| 1,074,958 | 7/1967 | United Kingdom | 72/209 |

*Primary Examiner*—Milton S. Mehr

*Attorney, Agent, or Firm*—Brisebois and Kruger

[57] ABSTRACT

The specification discloses a rolling mill for forming seamless tubes from an extruded blank wherein the mandrel is driven through the milling gap in a direction tangential to the milling rolls at a speed of from about 5% to about 10% of that of the tube blank during milling. Similarly the mandrel has a length of from about 5% to about 10% of that of the tube blank.

A further pair of milling rolls may be provided, adjacent the first and rotatable about mutually parallel axes orthogonal to the mutually parallel axes of rotation of the first pair of rolls in which case the mandrel will be twice as long as that required for a single milling roll gap.

8 Claims, 4 Drawing Figures

ROLLING MILL FOR FORMING SEAMLESS TUBES, AND SEAMLESS TUBE-MAKING APPARATUS COMPRISING SUCH A MILL

FIELD OF THE INVENTION

Currently, for the manufacture of seamless tubes, rolling mills of the "Stiefel" type are used to draw the tube by rolling a tube blank leaving an extrusion mill. These "Stiefel" type mills generally comprise a pair of milling rolls, a mandrel rod, and a mandrel capable of being fixed at that end of the rod at the region of the milling rolls and engaged in a tube blank between the rolls, the mandrel being held fixed between the rolls during milling by the fact that the end of the rod opposite to that which supports the mandrel is held fixed.

Mandrels used in these rolling mills are of small dimensions and are generally ogival in longitudinal section. These mandrels wear very rapidly and must be replaced after each milling pass. They are in general melted down with a view to making new mandrels.

It has already equally been proposed to displace the mandrel relative to the milling rolls during milling.

It can be seen however, on tubes obtained on the "Stiefel" rolling mills of conventional type, that the internal surface thereof is not of perfect quality and presents, in particular, grooves.

Furthermore, the tubes obtained in these conventional mills present a substantially constant thickness. During subsequent reduction rolling of the tube an increase of the thickness at the region of the extremities of the tube is produced and this then leads to decrease of the relatively important length dimension of the tube leaving the exit of the reduction-drawing mill.

BRIEF SUMMARY OF THE INVENTION

It is an object of the present invention to provide a rolling mill and apparatus, comprising this rolling mill, for the production of seamless tubes permitting the avoidance of the abovementioned disadvantages.

It is another object of the present invention to provide a rolling mill at the exit of which the tubes present an internal surface of high quality, free from the grooves inevitable with the conventional "Stiefel" type of rolling mill, and in which the thickness of the product tubes can be controlled in relatively simple fashion, particularly in the region of each end of the product tube.

It is a further object to permit the reduction of the importance of the part played by the reduction drawing mill and the consequent use of a simple, easily operated reduction drawing mill. This is achieved by virtue of the simple adjustment of the thickness of the tube in the rolling mill according to the present invention.

Accordingly the present invention provides in a rolling mill for forming a seamless tube from a tube blank and comprising (a) a pair of milling rolls defining a milling gap; (b) drive means for rotating said milling rolls; (c) a mandrel having a cylindrical portion extending along the major part of its length; (d) a mandrel rod having one end disposed adjacent said gap; (e) means for fixing said mandrel to said one end of said mandrel rod; and (f) drive means for displacing said mandrel, during milling, in a given direction tangential to said milling rolls the improvement wherein said drive means for displacing said mandrel are effective to advance said mandrel at a speed of from about 5% to about 10% of the peripheral speed of the milling rolls and said drive means for displacing the mandrel relative to the milling rolls are effective to pass the whole length of the mandrel between the milling rolls during a milling pass.

Thus for example for a tube length of about 15 meters, a mandrel is used whose length can be 1.5 meters. The weight of the mandrel for making a tube of about 120 mm diameter is thus 100 kgs or more. These values, given by way of example, are to be compared with those applicable to mandrels used in conventional "Stiefel" type rolling mills for which the length is of the order of several centimeters and the weight a few kilograms.

The present invention equally provides a rolling mill, of the type defined above, for manufacturing seamless tubes and comprising additionally a second pair of milling rolls, the axes of rotation of the rolls of one of the pairs being contained in a plane orthogonal to that containing the axes of rotation of the other of said pairs of milling rolls, the length of the mandrel being from about 10% to about 20% of the length of the tube blank being milled, (i.e. equal to twice the length defined hereinbefore for the mandrel used with a single pair of rolls), and the distance between said pairs of rolls being at least equal to half the length of the mandrel.

In another particular form of the invention the means for displacing the mandrel comprise a ram, preferably hydraulic, on which the piston is fixed during milling to the end of the mandrel rod opposite to that carrying the mandrel. According to the invention the mandrel and the rod are displaced in the course of milling in the direction of advance of the tube, that is to say from the milling rolls towards the ram, the speed of displacement of the mandrel and the mandrel bar, controlled by the ram, being advantageously of the order of 5 to 10% of the speed of movement of the tube being milled between the milling rolls, depending on the length of mandrel used.

The mandrel can comprise at at least one of its ends a short truncated conical portion. In one particular embodiment, each end comprises such a truncated conical part joined to the cylindrical portion forming the major part of the mandrel, by a second truncated conical portion defining an enlargement at each end of the mandrel. This arrangement permits the provision of a reduction of the thickness in the region of the ends of the milled tube. This effect can equally be obtained by pressing the milling rolls more firmly together during passage of the ends of the tube between the rolls. This last described embodiment, however, suffers from practical difficulties for its construction and use.

With a view to providing for cooling of the mandrel during milling, it is advantageous to provide in the mandrel rod, and in the jack piston to which the mandrel rod is fixed, a longitudinal internal cavity along which a cooling fluid passes.

The present invention equally provides apparatus for manufacturing seamless tubes and incorporating the rolling mill defined above. Typically this apparatus can comprise in succession: a furnace; a centering press; an extrusion mill; a rolling mill according to the present invention, the mill according to the invention preferably comprising two pairs of milling rolls on orthogonal axes; and like polishers from the outlet of which the tubes pass into an oven and then into a reduction drawing mill before being finally fed to a cooler.

PREFERRED EMBODIMENTS OF THE INVENTION

In order that the present invention can more readily be understood, one embodiment thereof will now be described by way of non-limiting example with reference to the accompanying drawings in which.

Figure 1:
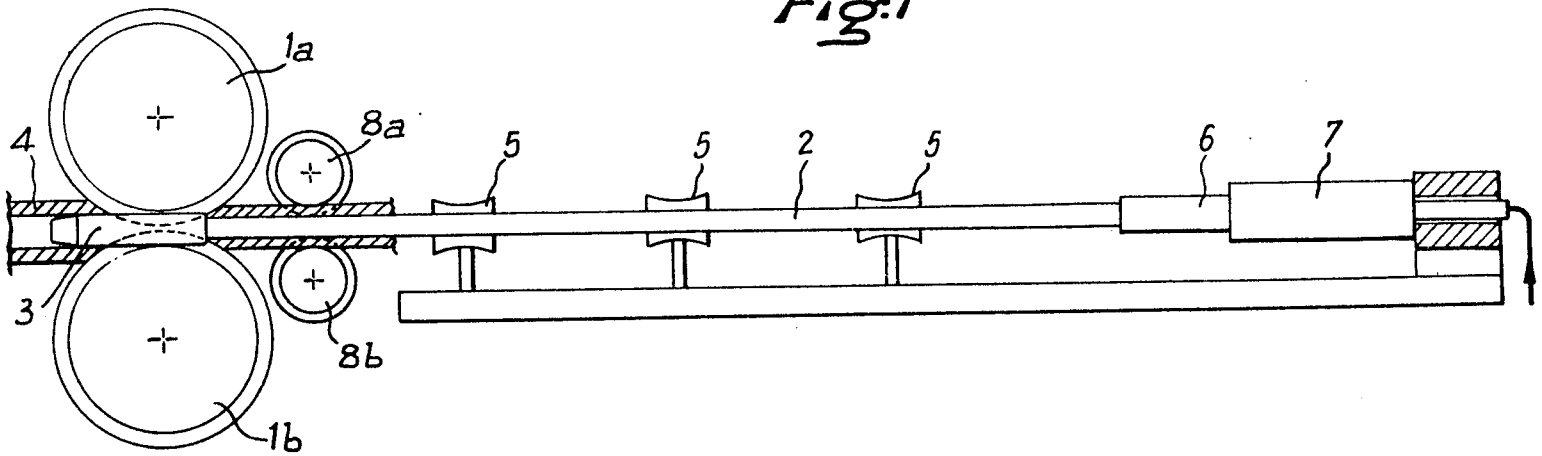
FIG. 1 is a schematic view of a rolling mill according to the invention.

The rolling mill which is shown in FIG. 1 comprises a pair of gap milling rolls 1*a* and 1*b* of conventional type. The rolling mill according to the invention comprises, as does a conventional "Stiefel" type of mill, a mandrel rod 2 provided with means at one end for receiving a mandrel 3 intended to be engaged in the gap between the milling rolls for milling an extruded tube blank 4 moving between the rolls. The mandrel 3 has a length of from about 5% to about 10% of the tube blank 4.

Because of its length, necessary to accommodate the entire length of the tube blank 4 therearound, the mandrel rod 2 is guided by guide elements 5 disposed along its length. At its end opposite that carrying the mandrel 3 the rod 2 is fixed to the piston 6 of an hydraulicram 7, as can best be seen in FIG. 4. In order to permit cooling of the mandrel during milling, the mandrel rod 2 and the piston 6 of the ram 7 are provided with a longitudinal cavity opening at the rear end of the piston rod of the piston 6, through which end a cooling fluid is introduced as schematically illustrated by the arrow at the right of FIG. 1. This cooling fluid is driven to flow towards the mandrel 3.

The rolling mill further comprises gap rolls 8*a* and 8*b* intended to extract the tube, after milling, as will be explained later.

Figure 3:
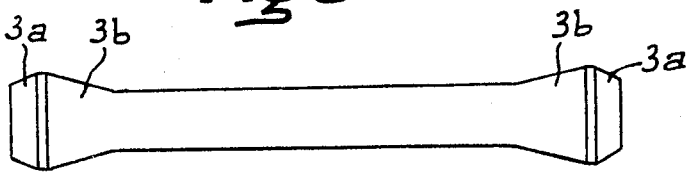
FIGS. 2 and 3 illustrate mandrels usable for the rolling mill of FIG. 1.
Figure 2:
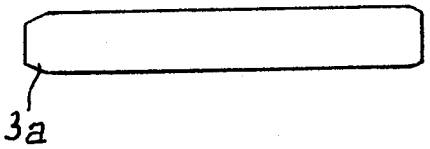

The mandrel used within the scope of the invention, through its considerable length, presents along at least the major part thereof a cylindrical section as can be appreciated from FIGS. 2 and 3 which show possible embodiments of the mandrel for use with the invention.

The mandrel shown on FIG. 2 presents, at its end opposite that intended to be fixed on the mandrel rod 2, a short truncated conical section 3*a* intended to facilitate penetration into the blank 4 on the mandrel 3 during milling.

The mandrel shown in FIG. 3 comprises at each end an enlarged portion, formed by a truncated conical section 3*a* and a truncated conical section 3*b*, which, during milling permit reduction of the thickness in the region of the ends of the rolled tubes.

There will now be described the summary of the operation of the mill of FIG. 1.

The rotating milling rolls 1*a* and 1*b* entrain advance of the blank therebetween and the milling of the blank against the mandrel 3 held by the mandrel rod 2.

Figure 4:
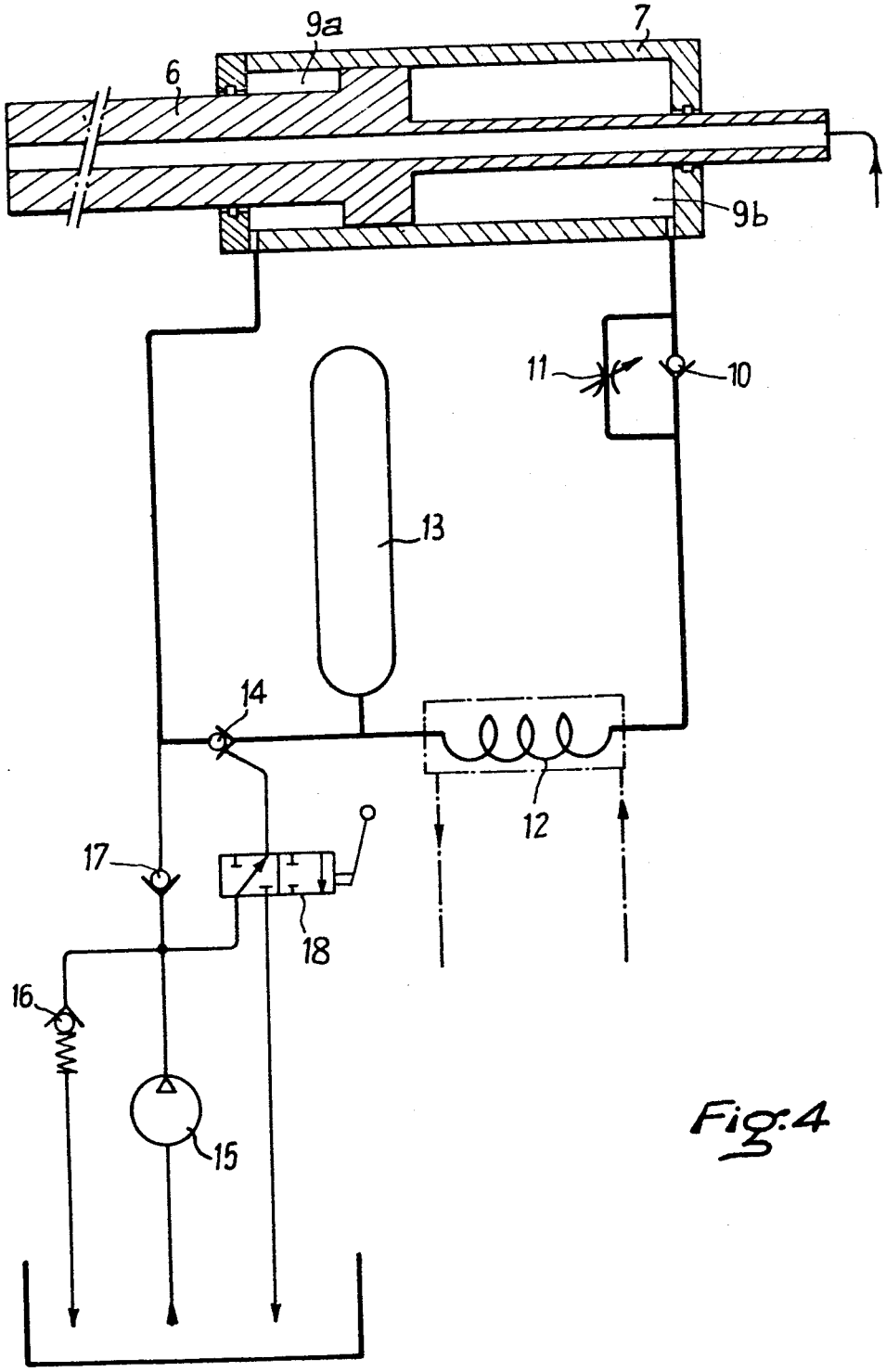
FIG. 4 shows one embodiment of hydraulic circuit for the ram used in the rolling mill of FIG. 1.

As can be seen with reference to FIG. 4, the ram 7 is operated in a manner to permit during milling a displacement of the mandrel 3 supported on the mandrel rod 2 relative to the milling rolls 1*a* and 1*b*. In advantageous manner, this ram 7 is operated in such a way as to allow the mandrel 3 to move in the direction of advance of the tube blank 4 during milling with a predetermined speed which is a function of the speed of advance of the tube. The speed of displacement of the mandrel is advantageously chosen to correspond to 5 to 10% of the speed of advance of the tube, depending upon the relationship between the length of the tube blank 4 and that of the mandrel. Thus, by virtue of the considerable length of the mandrel, and of the cylindrical cross section of its major part, and by virtue of the fact that the mandrel is moved with the tube, it is possible to assure during milling a considerable zone of contact between the internal surface of the rolled blank and the mandrel, thus permitting on the one hand the maintenance of a well controlled constant thickness of the resulting tube, and on the other hand the assurance of a high quality of internal surface of the tube and the elimination of the type of grooving obtained with the conventional small mandrels held fixed between the milling rolls during milling. The external surface of the mandrel according to the invention may advantageously be dressed with a lubrication agent, preferably a graphite-based lubricant.

Once one milling pass has been effected, that is to say when the blank 4 has once traversed the milling rolls 1*a* and 1*b* and found itself disposed on the mandrel rod 2, the milling rolls 1*a* and 1*b* are separated from one another and the further rolls 8*a* and 8*b* are operated in a manner to extract the tube from the rod. The mandrel is then ejected by return of the piston of ram 7 to its end position. Then a new mandrel is installed and the rolling mill is ready to receive a new tube blank for rolling.

The tube obtained is finally led to pass along polishers then in a reduction drawing mill. The functioning of the polishers can easily be adapted to the thinned ends of the tube.

By virtue of their particular configuration, and of their displacement relative to the milling rolls, the mandrels of the rolling mill according to this invention undergo a less critical wear than do the mandrels of conventional "Stiefel" mills and, because of this, can in general be reused after having meanwhile undergone appropriate machining.

There is shown in FIG. 4 one example of hydraulic circuit, usable with the ram 7 of the mill according to the invention, for the purpose of obtaining the desired displacement of the mandrel during milling.

The ram 7 is of double-acting type and comprises chambers 9*a* and 9*b*. The hydraulic circuit of this ram 7 comprises a main hydraulic circuit portion illustrated by thick lines on FIG. 4, and an auxiliary hydraulic circuit portion illustrated in finer lines.

The main hydraulic circuit portion comprises, connected to the chamber 9*b*, a non-return valve 10 associated with an adjustable throttle 11. The main circuit portion further comprises a heat-exchanger 12, a pressure accumulator 13 of membrane type, and a non-return valve 14 connected to the chamber 9*a* of the ram 7.

The auxiliary hydraulic circuit portion comprises a pump 15 connected to a reservoir of fluid, a pressure relief valve 16, a non-return valve 17 and a solenoid-operated valve 18. At the start of the milling pass, the piston 6 of the ram 7 is at the left hand end of FIG. 4. Under the mechanical action exerted by advance of the blank against the milling rolls the mandrel 3, the mandrel rod 2, and the piston 6 are driven for displacement in the direction of advance of the blank 4, that is to say the piston 6 is driven for rightward movement as viewed in the illustration of FIG. 4. The fluid in the chamber 9*b* is then driven to flow along the main hydraulic control circuit portion, closing the non-return valve 10 and flowing through the adjustable throttle 11.

The fluid is cooled in the heat-exchanger 12 and driven to circulate towards the membrane type pressure accumulator 13 and the chamber 9a of the ram 7. At the end of the milling pass, when the mechanical force on the piston 6 ceases, the fluid contained in the membrane accumulator 13 is released and returns towards the chamber 9b, this driving the piston 6 for leftward displacement to resume the position which it had at the beginning of the milling pass.

The auxiliary hydraulic circuit, shown in fine lines on FIG. 4, has the function of allowing the pump 15 to drive the fluid from one of the chambers 9a and 9b to the other in order to return the piston 6 at slow speed from the one to the other of its end positions when, for example due to stopping of the apparatus, it finds itself in an intermediate position in the ram cylinder.

It can be understood that by virtue of the apparatus illustrated in FIG. 4 the displacement of the piston 6, and thus of the rod 2 and of the mandrel 3, can be controlled during the milling pass such that by adjusting the operating parameters of the hydraulic circuit one can give the mandrel any desired speed of displacement.

It is particularly advantageous to provide in one embodiment (not shown) two pairs of milling rolls on orthogonal axes, the blank passing successively between the two pairs of milling rolls while on the same mandrel, it being understood that the spacing of the milling rolls, the length of the mandrel, and its speed of displacement are chosen as indicated above.

In this embodiment, with two pairs of milling rolls, the tube blank 4 is first threaded onto the mandrel-supporting rod and the assembly then pushed between the two milling rolls while the end of the mandrel rod is held by a hydraulic ram. For assuring thinning of the tube wall in the region of the ends of the tube it is advantageous to press the milling rolls together during passage of the ends of the tube through the gap therebetween.

In the rolling mill according to the present invention one can thus assure milling in a single pass, whilst in the conventional "Stiefel" type of mill two passes were generally necessary. Further, in the mill according to the present invention it is very easy to obtain the desired thicknesses for the tube leaving the apparatus for manufacturing the tubes, it being understood that it is then sufficient to choose a mandrel 3 having a diameter adapted to the thickness of tube which it is desired to obtain. One can reduce thus considerably the importance of the part played by the reduction drawing mill which can then be of a simplified type.

Although the invention has been described above in the context of one particular embodiment, it is clearly evident that there is no limitation to be implied thereby and that several different modifications can be incorporated without departing from the spirit and scope of the invention.

I claim:

1. A rolling mill for the manufacture of seamless tubes comprising a first pair of mill rolls and a second pair of mill rolls, the axes of rotation of the rolls of one of the pairs of rolls being contained in a plane orthogonal to that containing the axes of rotation of the other of said pairs of rolls, drive means for rotating said mill rolls, a mandrel rod, a mandrel having a cylindrical cross-section over the major portion of its length and capable of being fastened to the extremity of the mandrel rod at the region of the rolls, said mandrel being engaged in a tube blank between the rolls, drive means for displacing said mandrel relative to the rolls, during rolling, in the direction of advance of the tube blank, said mandrel having a length between about 10% and about 20% of the length of the rolled tube, and being displaced in relation to the rollers so that during a rolling operation, the mandrel moves over its entire length between the rolls of the two pairs of rolls, the distance between said pairs of rolls being at least equal to half the length of the mandrel, and said two pairs of rolls comprising the only mill rolls for rolling said blank.

2. An installation for manufacturing seamless tubes comprising the rolling mill of claim 1, followed by a rolling polisher.

3. A rolling mill as set forth in claim 1, wherein said drive means for displacing the mandrel comprises a ram having a piston and means for fixing said piston to the end of the rod opposite said one end.

4. A rolling mill as set forth in claim 3, wherein said ram is hydraulically driven.

5. A rolling mill as set forth in claim 1, wherein said drive means for displacing the mandrel and the drive means for rotating the milling rolls are effective to move the mandrel and the rod with a speed of the order of 5 to 10% of the speed of advance of the tube blank being milled and corresponding to the length of the mandrel.

6. A rolling mill as set forth in claim 1, wherein said mandrel has a short truncated conical portion at the end opposite to that which is fixed to the mandrel rod.

7. A rolling mill as set forth in claim 6, wherein said mandrel has, at each of its ends, an enlarged portion, constituted by a first truncated conical section joined to said cylindrical portion of the mandrel by a second truncated conical portion.

8. A rolling mill as set forth in claim 1 and including means defining a longitudinal internal cavity in the piston of the ram and in the mandrel rod for admitting a cooling fluid for the mandrel.

* * * * *